United States Patent [19]

Bouloy

[11] 4,103,949

[45] Aug. 1, 1978

[54] SAFETY DOOR LATCH

[76] Inventor: Jose B. Bouloy, P.O. Box F2666, Freeport G.B.I., The Bahamas

[21] Appl. No.: 684,117

[22] Filed: May 7, 1976

[51] Int. Cl.[2] ..... E05C 19/18

[52] U.S. Cl. ..... 292/342; 272/264

[58] Field of Search ..... 292/342, 343, 302, 292, 292/264, 294, 295, 296

[56] References Cited

U.S. PATENT DOCUMENTS

| | | | |
|---|---|---|---|
| 1,312,931 | 8/1919 | Tenny et al. | 292/205 |
| 1,470,751 | 10/1923 | Knapp | 292/205 X |
| 1,919,780 | 7/1933 | Fairbank | 292/342 X |
| 3,731,965 | 5/1973 | Adkinson, Jr. | 292/292 |
| 3,761,118 | 9/1973 | Westcott | 292/292 |
| 3,796,450 | 3/1974 | Schulz | 292/264 |

FOREIGN PATENT DOCUMENTS

| | | | |
|---|---|---|---|
| 7,002 of | 1909 | United Kingdom | 70/371 |

*Primary Examiner*—Richard E. Moore
*Attorney, Agent, or Firm*—Allen D. Brufsky

[57] ABSTRACT

A door latch including a two part keeper element and a latch element. Each part of the keeper element is L-shaped. The longer legs of each part are secured to the edge of a door and door frame, respectively, in back to back relation so that when the door is closed, the shorter legs of each part are in abutment in a vertical plane parallel to but spaced from the door. The latch element includes a hollow sleeve slid over the keeper element parts to retain them together precluding the door from being opened unless the sleeve is removed.

6 Claims, 4 Drawing Figures

SAFETY DOOR LATCH

BACKGROUND OF THE INVENTION

This invention relates to an improved latch for a door.

Door latches heretofore have consisted of a latch element, such as a slideable bolt, a chain, or pivotal lever which are mounted on the door and span the space between the door and its frame or jamb and are held within a stationary keeper element on the frame or an adjacent wall. These latches are used as a supplement to the ordinary door lock to prevent unauthorized entry through the door. Too often however, an intruder can enter by applying force to the door to either break the connection between the movable latch element and its stationary keeper or to cause the keeper and latch element to be separated together from the door or frame.

SUMMARY OF THE INVENTION

Accordingly, the latch of this invention is designed for sturdier protection. The latch comprises a two part keeper element. Each part is L-shaped. The longer leg of one part is attached to the side of the door and the longer leg of the second part is attached to the side of the frame at the same elevation as the part attached to the door so that the shorter legs of each part of the keeper element are in abutment when the door is closed and lie in the same vertical plane parallel to but spaced from the door and frame.

A hollow sleeve or latch element is positioned over both parts of the keeper element by sliding it downwardly over the abutting legs to retain the parts of the keeper element in abutment preventing the door from being opened unless the sleeve is removed.

A pivotal handle can be attached to the sleeve for raising and lowering it relative to the keeper parts. The handle has a hook at one end which passes through a slot in the sleeve and a complemental slot in one of the keeper parts when the sleeve is slid over the keeper parts to prevent the sleeve from being removed from the keeper unless the handle is first pivoted to remove the hook from the slots from the interior side of the door.

BRIEF DESCRIPTION OF THE DRAWING

Further objects and advantages of the invention will become more apparent from the following description and claims and from the accompanying drawing, wherein:

DETAILED DESCRIPTION OF THE PREFERRED EMBODIMENTS

Figure 1:
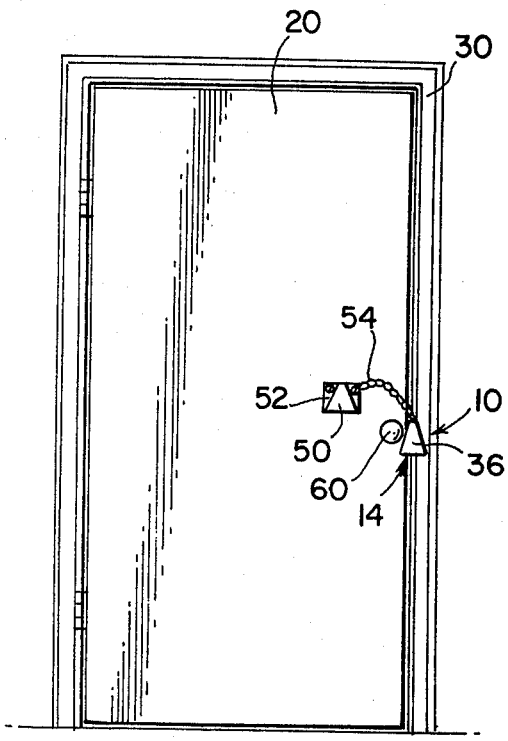
FIG. 1 is a side view in elevation of the interior surface of a door provided with a door latch of the present invention.

Referring now in detail to the drawing, wherein like numerals indicate like elements throughout the several views, the door latch 10 of the present invention includes a keeper element 12 and a latch element 14.

Keeper element 12 includes an L-shaped part 16 whose longer leg 18 is attached to the side of door 20 by conventional screw fasteners (not shown) and a second L-shaped part 22 whose longer leg 24 is attached by screw fasteners 26 inserted through holes 28 to side of door frame 30 at the same elevation as part 16 so that the shorter legs 32, 34 of the L-shaped parts 16, 22, respectively, of keeper element 12 are in abutment when door 20 is closed and lie in the same vertical plane parallel to but spaced from door 20 and frame 30.

Figure 2:
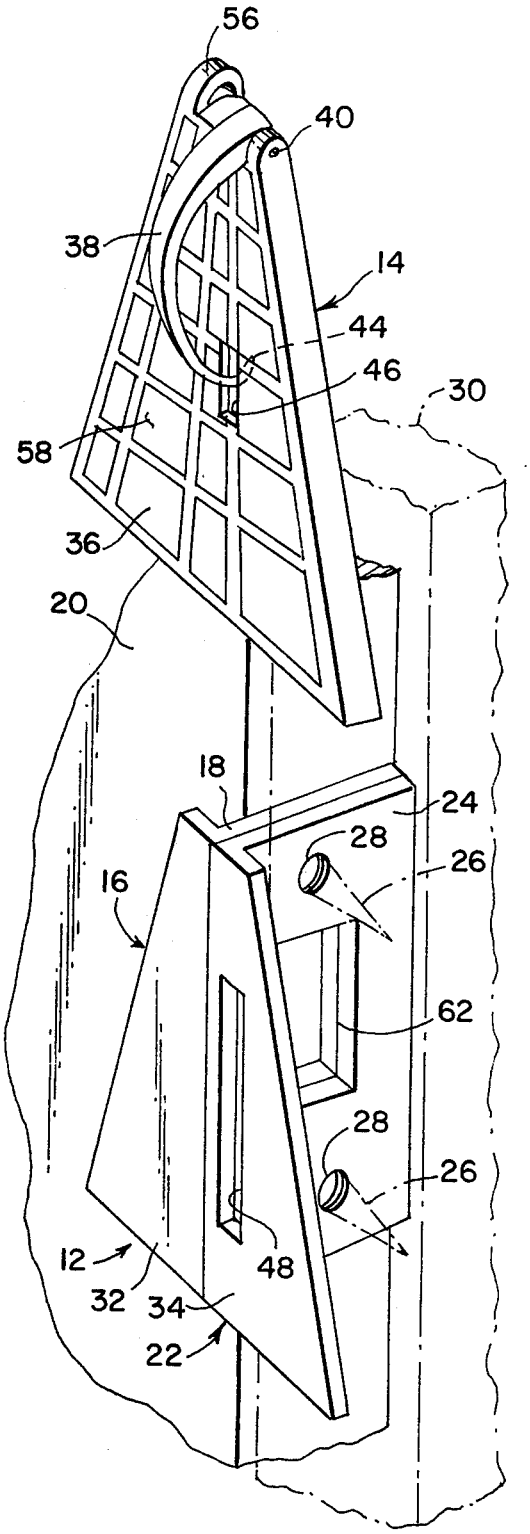
FIG. 2 is an exploded perspective view of the door latch of FIG. 1.

Latch element 14 includes a hollow sleeve 36 which is complemental in shape to the abutting shorter legs 32, 34 of keeper element 12. As shown in FIG. 2, each of legs 32, 34 is in the shape of a right triangle, while sleeve 36 is in the shape of an isoceles triangle.

Figure 3:
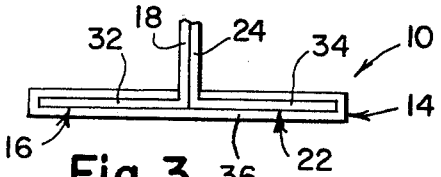
FIG. 3 is a bottom view in elevation of the assembled door latch of FIG. 2.

As shown in FIG. 3, sleeve 36 is positioned over the shorter legs 32, 34 of keeper element 12 by sliding it downwardly over the abutting legs to retain the parts 16 and 22 of keeper element 12 in abutment preventing door 20 from being opened unless sleeve 36 is removed.

A handle 38 for raising and lowering sleeve 36 relative to keeper element 12 is pivotally connected by a pin 40 to the top of sleeve 36. Handle 38 has a hook 44 at its opposite end which passes through a slot 46 in sleeve 36 and a complemental slot 48 in the shorter leg 34 of keeper part 22 when the sleeve 36 is slid over the keeper element 12 to prevent sleeve 36 from being removed from the keeper element 12 by sliding it upwardly by contact with a knife or other edge inserted between the door 20 and frame 30 from the exterior of door 20. Sleeve 36 can only be removed if handle 38 is first pivoted to remove hook 44 from slots 46 and 48 from the interior side of door 20 or hook 44 will catch at the top of slot 48 to prevent separation of sleeve 36 from keeper element 12.

As shown in FIG. 1, sleeve 36 may be retained, if desired, on a complementally shaped holder 50 when not in use. Holder 50 is mounted on a plate 52 threadedly connected to the interior surface of door 20 and includes a chain 54 integral with holder 50 which is secured to a loop 56 extending from the top of sleeve 36 by conventional means. A decorative design 58 may be imprinted by suitable indicia on sleeve 36 to make it attractive to the eye.

Furthermore, keeper element 12 may cooperate with the conventional latch connected to door knob 60 for added security. The longer legs 18, 24 of keeper parts 16, 22 respectively, have mating slots 62 for receiving this latch therethrough. Accordingly, door 20 must first be unlocked and knob 60 rotated and sleeve 36 removed, before door 20 can be opened.

Figure 4:
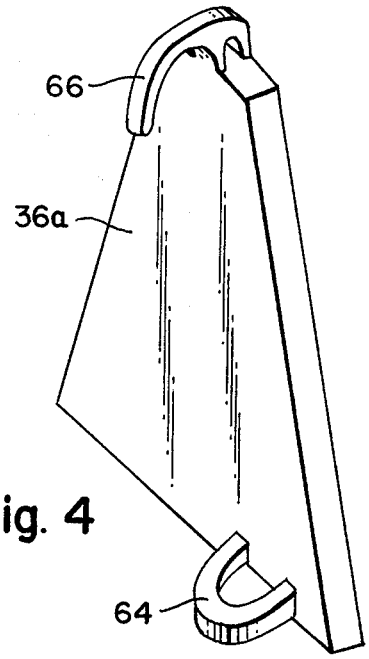
FIG. 4 is a perspective view of a modified form of latch element.

A modified form of sleeve 36 is illustrated in FIG. 4 for use with a pair of abutting doors or a gate commonly found in a commercial establishment.

Sleeve **36*a* performs the identical function as sleeve 36 with respect to a keeper element 12 mounted on adjacent edges of abutting doors or gate sections, except that a loop 64 extends outwardly from its front surface which will seat on an identical loop provided on keeper part 22. A padlock can be placed through the loops 64 to lock the sleeve 36*a* to the keeper element. In this embodiment, a fixed finger hook 66 is attached to the top of sleeve 36*a* to raise and lower sleeve 36*a*** relative to the keeper element.

I claim:

1. A safety latch for a door or the like comprising:

a keeper element including a first and second L-shaped part, each part being adapted to have one of its legs attached to the edge of a door and a door frame or the like, respectively, in back to back relation so that when the door is closed the other legs of each part will be in abutment in the same vertical plane parallel to but spaced apart from the door and door frame;

a latch element adapted to be slid and positioned over the other legs of said keeper element to retain the first and second parts of said keeper element in abutment so they cannot be separated to prevent opening of a door, said latch element including, a hollow sleeve having a complemental shape to said other legs of each keeper part when they are positioned in back to back relation; and handle means for raising and lowering said sleeve relative to said keeper element parts, said handle means being pivotally connected to said sleeve and including a hook at the end thereof remote from said pivotal connection, a slot in said sleeve, and a complemental slot in said other leg of one of said keeper parts, the hook on said end of said handle means being received within said complemental slots to preclude removal of said sleeve from said keeper parts.

2. A safety latch in accordance with claim 1 wherein the legs of said keeper parts which are adapted to be connected to said door and door frame, respectively, include complemental slots for receiving an additional latch element.

3. A safety latch in accordance with claim 1 wherein one of the other legs of one part of said keeper element and said sleeve include a loop for receiving a lock therethrough.

4. A safety latch in accordance with claim 1 wherein the other legs of said keeper element are in the shape of a right triangle and said hollow sleeve is in the shape of an isoceles triangle.

5. A safety latch in accordance with claim 1 including:

a holder for said sleeve adapted to be attached to a door, said holder including:

a plate having a portion complemental in shape to said sleeve to slidably receive said sleeve, and means connecting said plate to said sleeve.

6. A safety latch in accordance with claim 5 wherein said connections means includes a chain.

* * * * *